US005197665A

United States Patent [19]

Jenson et al.

[11] Patent Number: 5,197,665

[45] Date of Patent: Mar. 30, 1993

[54] WATER HEATER

[75] Inventors: Maurice Jenson, Mississauga; Theodore Slone, Etobicoke, both of Canada

[73] Assignee: Rheem Canada Ltd., Hamilton, Canada

[21] Appl. No.: 619,938

[22] Filed: Nov. 29, 1990

[51] Int. Cl.[5] ..... F22B 35/00

[52] U.S. Cl. ..... 236/26 D; 236/20 R; 431/31

[58] Field of Search ..... 431/20, 31; 237/19; 126/101; 236/20 R, 26 D

[56] References Cited

U.S. PATENT DOCUMENTS

| | | | |
|---|---|---|---|
| 2,671,503 | 3/1954 | Logan et al. | 431/31 X |
| 4,370,126 | 1/1983 | Miyanaka et al. | 431/31 X |
| 4,856,982 | 8/1989 | Olson | 431/20 |

*Primary Examiner*—Henry Bennett
*Attorney, Agent, or Firm*—Baker & Daniels

[57] ABSTRACT

A water heater includes a tank for receiving cold water and dispensing heated water. A thermostat is associated with the tank and detects the temperature of water held therein. A gas burner including a hot surface igniter receives fuel to be combusted via a fuel line when a valve on the fuel line is opened. A controller is responsive to the thermostat and opens the valve and operates the igniter to ignite the fuel when the temperature of the water held in the tank falls below a first predetermined level. A vent including a flue passes through the tank and allows combustion gases and heat of combustion to be vented from the water heater. The vent includes a blower responsive to the controller which mixes ambient air with combustion gases prior to venting the combustion gases to the atmosphere. The controller initiates the blower when the water temperature falls below the first predetermined level to establish at least a predetermined pressure in the flue before the valve and igniter are operated. When the water temperature rises to a second predetermined level, the controller shuts off the igniter and the valve and maintains the blower in operation for a preset time to exhaust substantially all combustion gases and heat of combustion from the water heater.

40 Claims, 7 Drawing Sheets

WATER HEATER

The present invention relates to devices for heating liquids and in particular to a water heater.

Conventional gas water heaters include a water filled tank vessel under which a gas burner is located. The gas burner is ignited by a continuously burning pilot light when the temperature of the water held in the tank falls below a preselected temperature. Thus, the pilot light is continuously fed with a supply of gas unless the pilot light is extinguished at which time the supply of gas to the pilot light is cut off. A centrally located flue passes through the tank vessel and is connected to metal piping extending to the atmosphere to vent atmospherically combustion gases and heat of combustion. During operation of these conventional heaters, when the temperature of the water in the tank vessel falls below the preselected temperature, gas flow to the burner is permitted and is ignited by the burning pilot light so that the water in the tank is heated. Heat of combustion and combustion gases are then discharged from the water heater via the flue and pass through the metal piping to the atmosphere. Metal piping is typically used since it is capable of withstanding the high temperature of the combustion gases and excess heat of combustion.

However, problems exist in this design in that even when the burner is not operating, gas is still combusted to maintain the pilot light. In addition, since the combustion gases and excess heat of combustion are vented atmospherically, expensive metal piping must be used to direct the combustion gases from the water heater to the atmosphere due to the typical high temperatures of the combustion gases. This of course increases costs when installing the water heater.

It is therefore an object of the present invention to obviate or mitigate at least one of the above disadvantages by providing a novel water heater.

According to one aspect of the present invention, there is provided a water heater comprising:

a tank adapted to hold water;

temperature sensing means associated with said tank for detecting the temperature of water held in said tank;

a burner receiving fuel to be combusted; control means responsive to said temperature sensing means and operating said burner to ignite said fuel when the temperature of water held in the tank falls below a first predetermined level; and vent means for discharging combustion gases, said vent means including blowing means responsive to said control means for mixing a cooling medium with said combustion gases, said control means further initiating said blowing means when the temperature of water held in said tank falls below said predetermined temperature to establish at least a predetermined pressure in said vent means prior to operating said burner.

Preferably, the cooling medium is ambient air and the control means shuts off the burner when the water temperature reaches a second predetermined temperature greater than or equal to the first predetermined temperature and operates the blowing means for a predetermined duration after the burner has been shut off. It is also preferred that the operation of the burner is inhibited by the control means until the blowing means creates a pressure in the vent means at least equal to 0.6 inches water column.

Preferably, the burner includes a valve connected to a gas supply and an electrically controlled hot surface igniter for igniting the gas with the control means operating the igniter after the blowing means has established the predetermined pressure in the vent means. When the igniter is detected as reaching the combustion temperature of the gas, the valve is opened allowing the gas to be ignited. It is also preferred that the burner includes a temperature sensor for detecting the temperature upon ignition of the gas and a relay operable to shut off the igniter once the valve is opened and the gas is ignited.

Preferably, the blowing means includes a motor-driven fan which is operated by the control means to create the predetermined pressure. Circumferencially located holes are provided in a fan housing located above the tank for permitting ambient air to be combined with the combustion gasses. It is also preferred that the vent means is in the form of a flue extending from the burner to the fan housing and passing through the tank and that outlet piping formed from PVC or ABS receives the ambient air and the combustion gas mixture discharged by the fan so that the mixture can be vented to the atmosphere.

According to another aspect of the present invention there is provided a gas water heater comprising:

a tank adapted to hold water;

temperature sensing means associated with said tank for detecting the temperature of water held in said tank;

a burner receiving gas to be combusted and including ignition means for igniting said gas;

valve means operable to control the flow of gas to said burner;

control means responsive to said temperature sensing means, said control means operating said valve means to supply gas to said ignition means and operating said ignition means to ignite said gas when the temperature of water held in said tank falls below a first pre-determined level; and vent means for discharging combustion gasses.

The present invention provides advantages in that since the blowing means creates a pressure differential in the vent and combines the combustion gases with ambient air, the temperature of the combustion gases is rapidly reduced before it is conveyed to piping external to the water heater and vented to the atmosphere. This allows an inexpensive conduit such as PVC or ABS piping to be used to vent the combustion gases from the water heater to the atmosphere. Moreover, since an electrically operated ignitor is used to ignite the gas when the water temperature in the tank falls below the first predetermined temperature level, fuel is not combusted while the burner is inoperative as occurs in prior art devices employing pilot lights. This of course reduces fuel consumption.

An embodiment of the present invention will now be described by way of example only with reference to the accompanying drawings in which.

Figure 2:
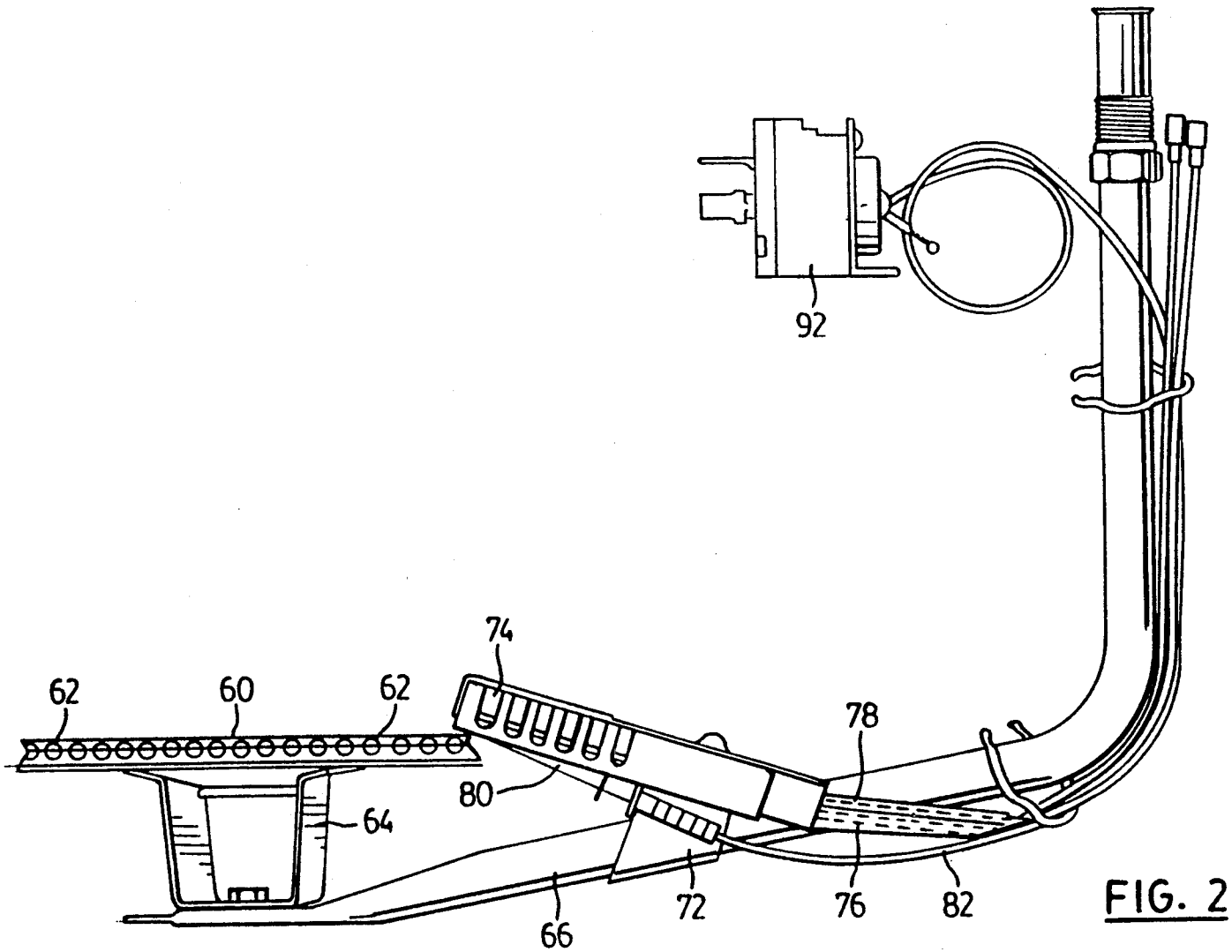
FIG. 2 is a side view of a portion of the water heater shown in FIG. 1.
Figure 4A:
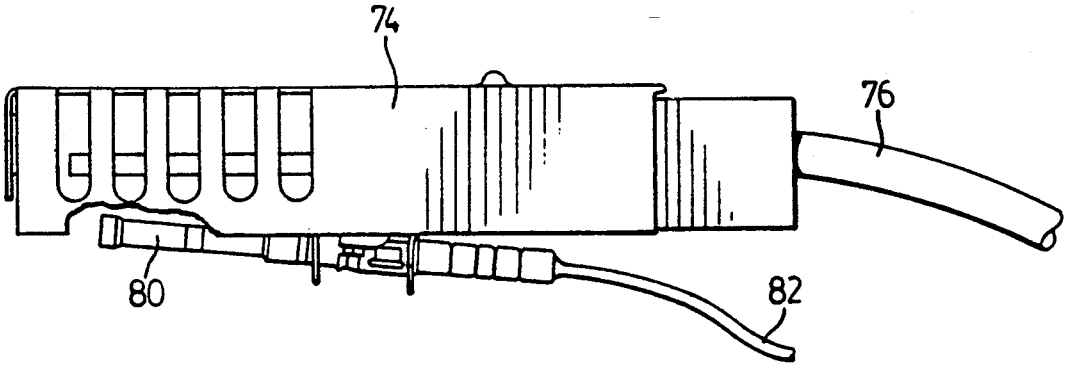
Figure 4B:
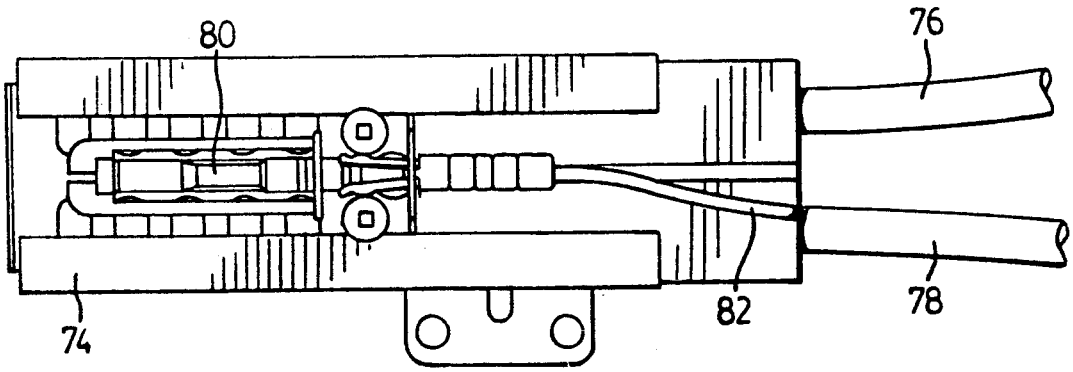

FIG. 4*a* is a side view of an element of the portion shown in FIG. 2;

FIG. 4*b* is a bottom plan view of the element shown in FIG. 4*a;*

Figure 1:
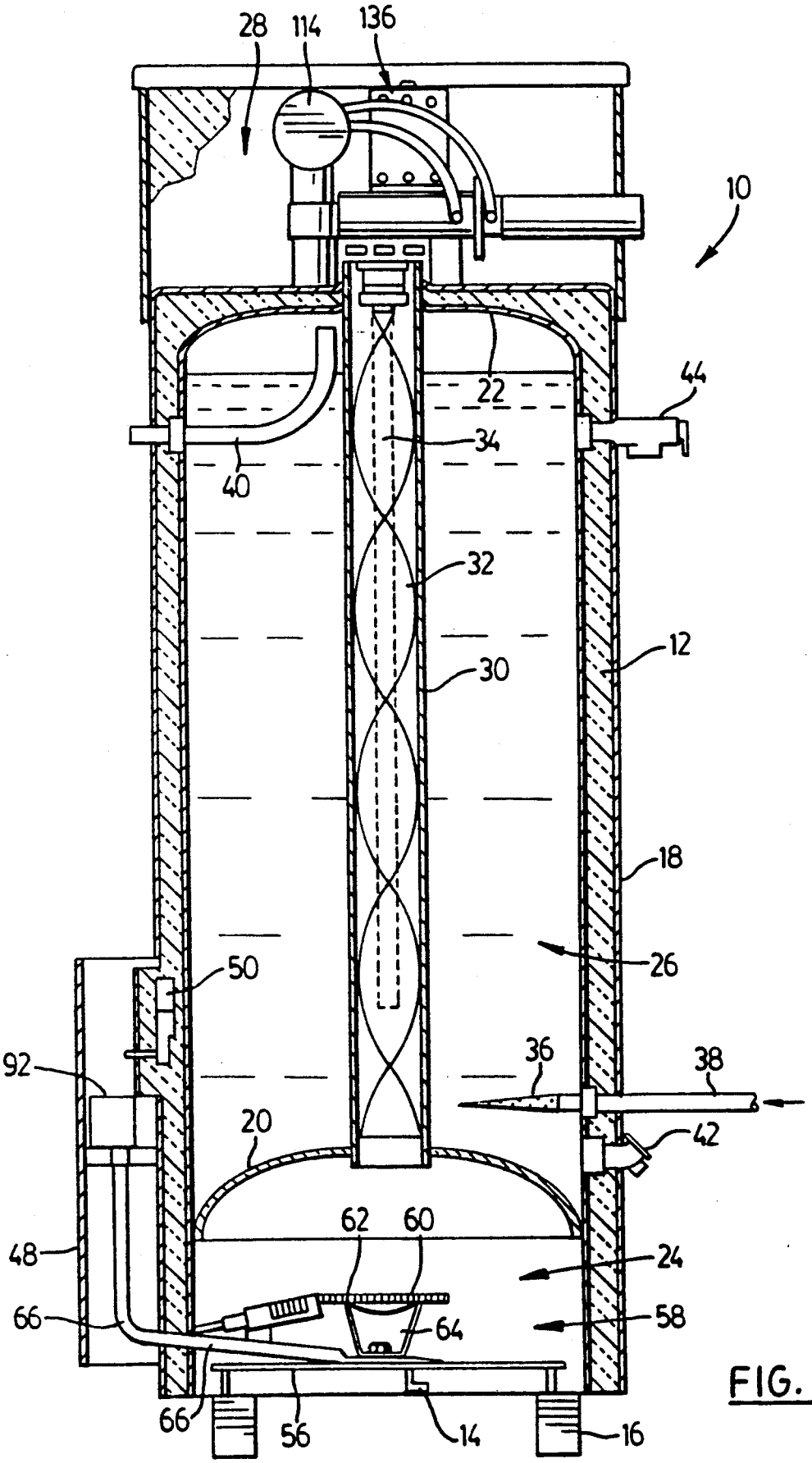
FIG. 1 is a side view of a water heater.
Figure 5:
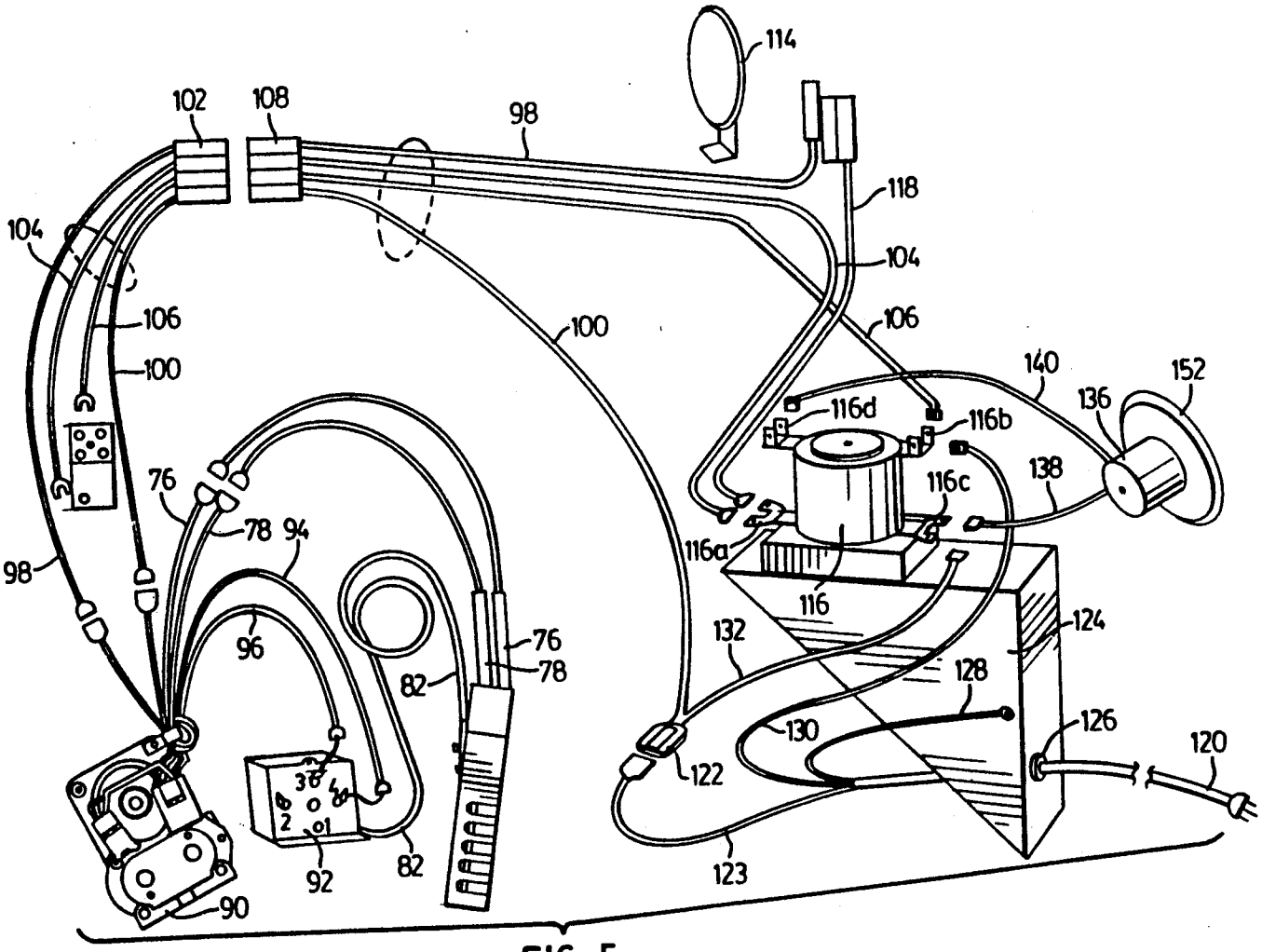
Figure 6:
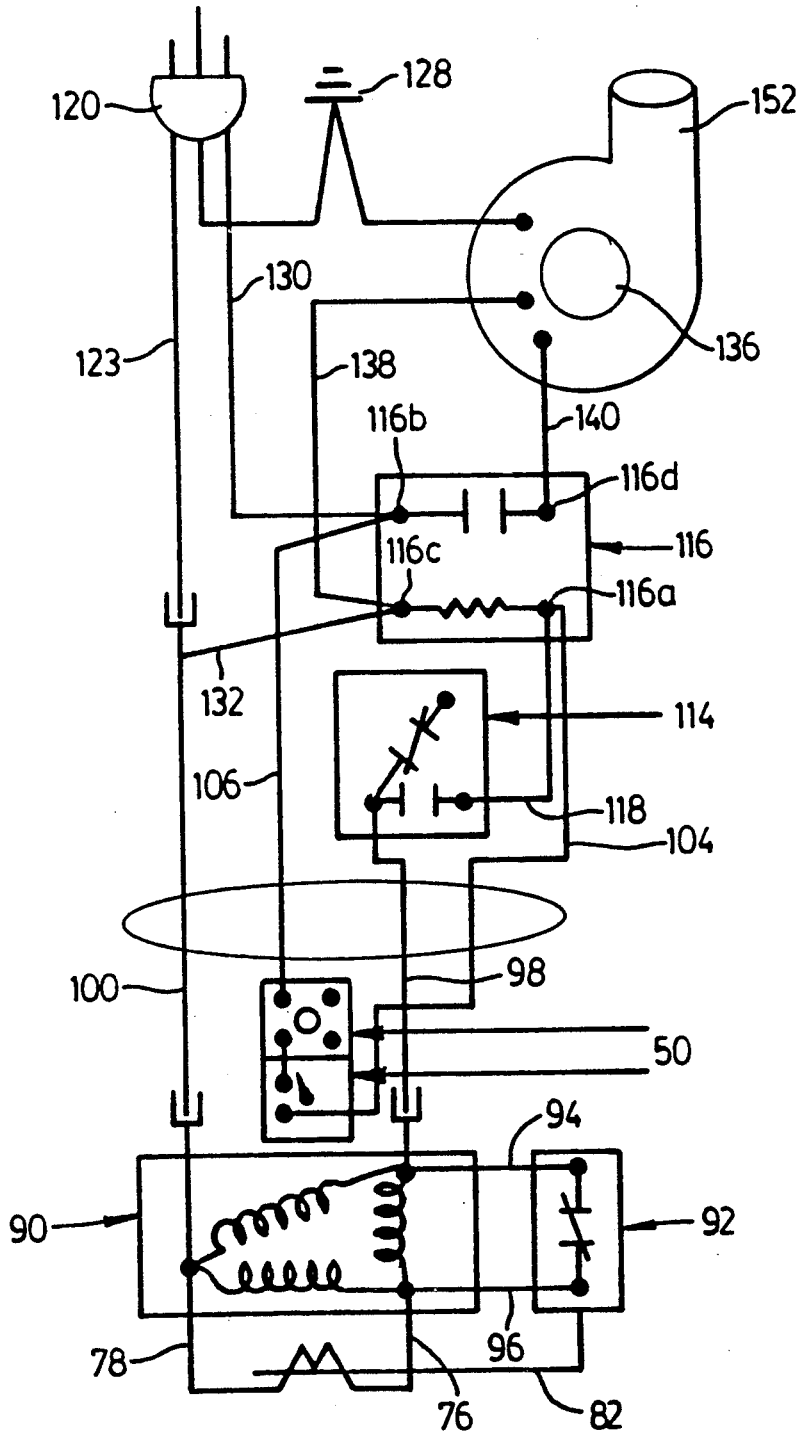

FIG. 5 is a diagram illustrating the wiring of components used in the water heater shown in FIG. 1;

FIG. 6 is a schematic view of the wiring diagram shown in FIG. 5; and

Figure 7:
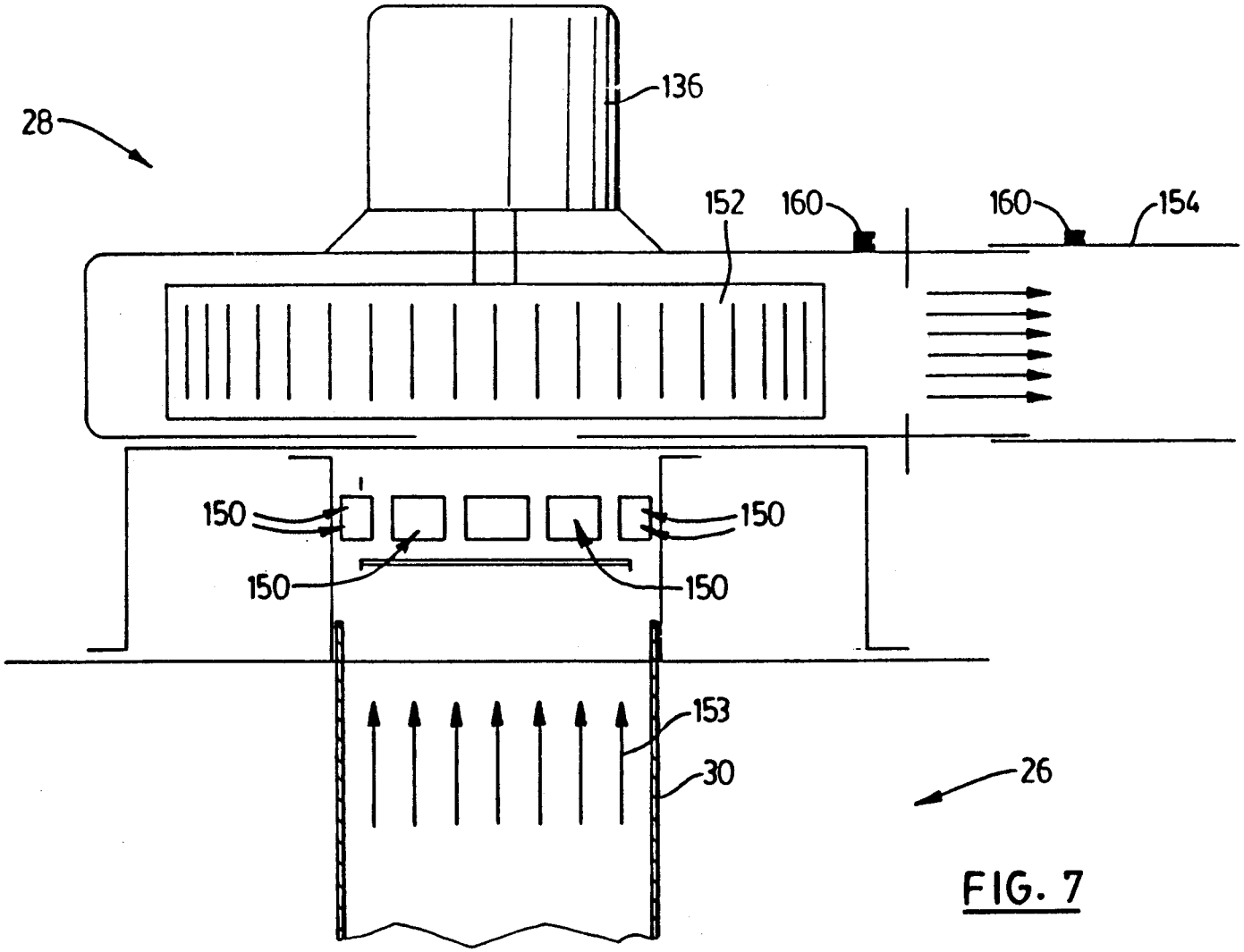

FIG. 7 is a side view of another portion of the water heater shown in FIG. 1.

Referring now to FIG. 1, a gas-fired water heater is shown and is generally indicated by reference numeral 10. The water heater includes a cylindrical tank 12 having a base 14 spaced from the ground by legs 16. The tank 12 is surrounded by an insulating jacket 18 and is divided into three chambers by a pair of inner walls 20,22 namely a combustion chamber 24, a water storage chamber 26 and an exhaust chamber 28. The combustion and exhaust chambers 24,28 respectively are however connected by a cylindrical flue 30 extending through the tank 12. The cylindrical flue houses a helical baffle 32. An anode rod 34 lies within the water storage chamber 26 and is secured at its upper end to the inner wall 22.

The water storage chamber 26 accounts for the majority of the tank 12 and as its title suggests, holds the water to be heated. An inlet diffuser 36 passes through the insulating jacket 18 and the outer wall of the tank 12 adjacent its lower end to permit water received from a cold water supply 38 to enter the tank. An outlet tube 40 located adjacent the upper part of the tank 12 allows heated water to exit the tank 12 and the jacket 18 as needed. A drain valve 42 is located below the inlet diffuser 36 while a pressure relief valve 44 is located adjacent the outlet tube 40.

A cabinet 48 is mounted on the tank 12 and houses a thermostat 50 which monitors the temperature of the water in the tank. The thermostat 50 is adjustable to allow the water temperature to be maintained at the desired temperature. The thermostat 50 communicates with additional components in the cabinet 48 so that the water in the tank 12 is heated when appropriate as will be described.

Figure 3:
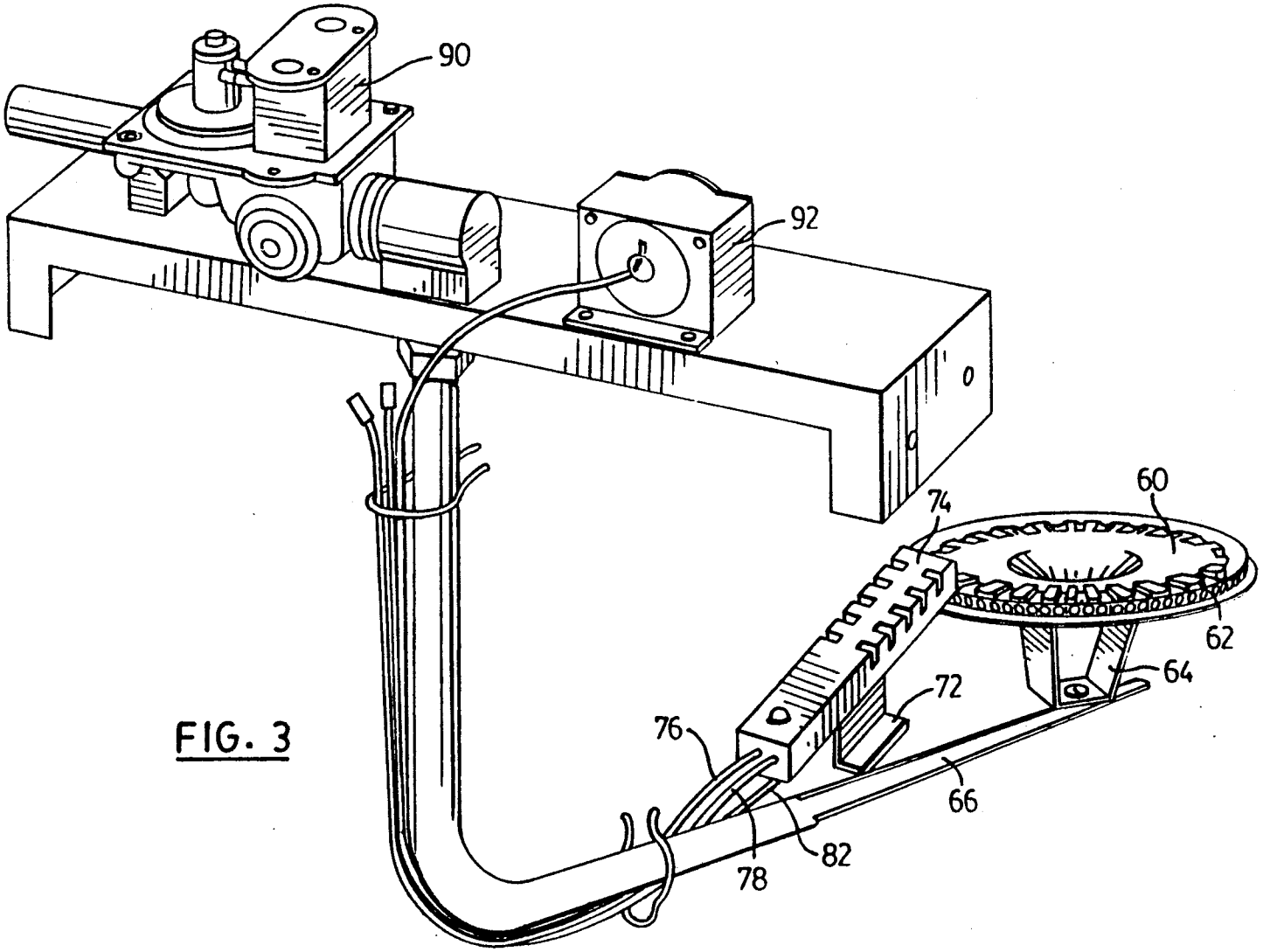
FIG. 3 is a perspective view of the portion of the water heater shown in FIG. 2.

Within the combustion chamber 24, a floor shield 56 rests above the base 14 of the tank 12. The floor shield 56 supports a gas burner 58 which is aligned with the longitudinal axis of the flue 30. The gas burner 58 although illustrated in FIG. 1 is best shown in FIGS. 2 to 4. The burner 58 includes a circular pan 60 having a plurality of circumferencially located holes 62 formed therein. The holes communicate with a V-shaped bracket 64 which acts to space the pan 60 from the floor shield 56 and to direct the flow of gas received from a gas supply line 66 through the holes 62.

An igniter 74 and a mercury temperature sensor 80 having a remote sensing bulb are mounted on an inclined bracket 72 secured to the gas supply line 66 so that the upper end of the igniter 74 rests over the pan 60. The igniter 74 is electrically connected to control circuitry housed in the cabinet 48 via a pair of conductors 76 and 78 respectively. The mercury temperature sensor 80 is disposed beneath the igniter 74 and is also connected to the control circuity via a capillary tube 82.

Referring now to FIGS. 5 and 6, the control circuitry is better illustrated and includes an M25 dual coil fail-safe solenoid valve 90 such as that manufactured by White Rogers connected between the gas supply and the supply line 66. The valve 90 also receives the conductors 76 and 78 extending from the igniter 74. A mercury filled relay 92 is also connected to the solenoid valve 90 via conductors 94 and 96 and receives the capillary tube 82 extending from the mercury temperature sensor 80. A pair of electrical leads 98,100 extend from the solenoid gas valve 90 and terminate at a male plug 102 which also receives conductors 104,106 connected to the thermostat 50. The male plug 102 mates with a female plug 108 to connect the thermostat 50 and the solenoid gas valve 90 to a power supply and to additional control circuitry components.

The conductor 98 extending from the solenoid gas valve 90 via the plugs 102,108 terminates at a differential pressure switch 114 located within the exhaust chamber 28. The pressure switch 114 is also connected to a first terminal 116*a* of a thermal delay relay 116 (also located in the exhaust chamber 28) by a conductor 118. The delay relay 116 also receives both conductors 104,106 from the thermostat 50 via the plugs, with conductor 104 terminating at terminal 116*a* of the delay relay and conductor 106 terminating at terminal 116*b* of the delay relay. The other conductor 100 extending from the solenoid gas valve 90 extends to "cold" conductor 123 of power cord 120 via a splitter 122. The power cord 120 is secured to a mounting bracket 124 by a strain relief assembly 126 and also provides a ground connection 128 to the mounting bracket 124. A "hot" conductor 130 extends from the power cord 120 to terminal 116*b* of the delay relay 116. A second conductor 132 extends from the splitter 122 to terminal 116*c* of the delay relay 116. A motor 136 positioned above and spaced from the top of the flue 30 is connected across terminals 116*c* and 116*d* of the delay relay 116 via conductors 138 and 140 respectively.

Referring now to FIG. 7, the exhaust chamber 28 is better illustrated and as can be seen, it includes a plurality of inlets 150 circumferencially arranged and located above the flue 30. A fan 152 driven by motor 136 is located above the inlets 150 and draws ambient air into the exhaust chamber 28 via the inlets 150 so that the ambient air mixes with combustion gases 153 generated in the combustion chamber 24 and passing through the flue 30. An outlet pipe 154 formed from PVC or ABS material and forming a right angle with the longitudinal axis of the tank 12 is connected to the flue 30 adjacent the fan 152. Pressure sensors 160 are located at spaced locations along the outlet pipe and communicate with the pressure switch 114. The outlet pipe 154 extends exterior to the location wherein the water heater 10 is installed to vent the combustion gases, ambient air and any excess heat of combustion atmospherically.

The operation of the present water heater 10 will now be described with reference to the accompanying drawings. When the tank 12 is filled with water and heated to a predetermined temperature as determined by the setting of the thermostat 50, the heated water may be withdrawn via the outlet 40 as required. As water is withdrawn, it is replenished via the inlet diffuser 36 connected to the cold water supply 38. While this is occurring, the thermostat 50 continuously monitors the water temperature within the tank 12.

As long as the water temperature remains above or equal to the thermostat setting, the burner 58 is maintained in an "off" condition. However, when the water temperature falls below the temperature setting of the thermostat 50, the thermostat 50 closes its contacts thereby connecting terminal 116*a* of the relay 116 to the power supply via the closed circuit constituted by conductors 130,106 and 104 respectively. At the same time, the pressure switch 114 which is also connected to terminal 116*a*, is connected to the power supply via conductors 118,98,100 and 123 respectively and begins monitoring the output of the pressure sensors 160.

When this occurs, the delay relay 116 remains open for approximately twenty seconds and then closes its contacts between terminals 116*b* and 116*c* thereby connecting the motor 136 between the "hot" and "cold" conductors 130, 123 respectively extending from the power cord 120. With the motor 136 energized, the fan 152 is rotated so that air is withdrawn from the combustion chamber 24 via the flue 30 into the exhaust chamber 28. In addition, ambient air is also drawn into the exhaust chamber 28 via the inlets 150 and is mixed with the air drawn from the combustion chamber 24. The pressure switch 114 which monitors the pressure sensors 160 disposed along the outlet pipe 154 closes its contacts when the pressure sensors 160 detect a pressure level in the outlet pipe of 0.6 inches water column (W.C.).

Once this pressure level is detected and the pressure switch contacts are closed, electrical power is conveyed to the solenoid gas valve 90, and to the igniter 74 via the mercury filled relay 92. Once the igniter 74 is energized, the temperature of the igniter increases. When the temperature of the igniter reaches the ignition temperature of the gas, it is detected by the mercury filled relay 92 through the temperature sensor 80 via capillary tube due to the mercury expansion principle. This causes the mercury filled relay 92 to open its contacts thereby re-routing electrical power through the secondary coil of the solenoid gas valve 90 causing it to open so that gas passes along the supply line 66 to the bracket 64 and upwardly to the pan 60. The gas then passes outwardly through the holes 62 and is ignited by the igniter 74 which is at the ignition temperature of the gas. Once the mercury filled relay contacts open, the igniter 74 is isolated from the power supply to reduce power consumption. Although the igniter 74 is de-energized as the solenoid gas valve 90 is opened, it is normally at a temperature which will ignite the gas supplied to the pan 60. As gas is combusted, the temperature sensor 80 monitors the temperature at the pan 60. As long as the gas is being combusted, the mercury filled relay contacts are kept open so that the solenoid gas valve 90 remains open.

The burning gas is used to heat the water held in the tank 12. The combustion gases and excess heat of combustion resulting from the burning gas which reach temperatures in excess of 500° F. are drawn from the combustion chamber 24 into the exhaust chamber 28 via the flue 30 and are combined with ambient air entering the exhaust chamber 28 via the inlets 150. The ambient air cools the combustion gases quickly to a temperature of about 200° F. and forces the combined ambient air and combustion gas mixture through the outlet piping 154 so that it may vented to the atmosphere exterior to the location wherein the water heater 10 is installed.

When the water temperature in the tank reaches the preselected temperature as determined by the setting of the thermostat 50, the thermostat 50 opens its contacts thereby de-energizing the solenoid gas valve 90 so that gas flow to the burner 58 is inhibited. However, the electrical contact to the motor 136 is maintained for approximately 90 seconds so that the combustion chamber 24 and flue 30 are exhausted of substantially all combustion gases and residual heat before the delay relay 116 opens its contacts to isolate terminals **116*b* and 116*d* and isolate the motor from the power supply. When this occurs, the water heater returns to its initial condition so that the above described process can be recommenced when the temperature of the water held in the tank 12** once again falls below the thermostat setting.

It should be realized that if the gas is not ignited with the solenoid gas valve 90 open, the mercury filled relay 92 detects this condition via the temperature sensor 80 and capillary tube 82 and closes its contacts. This in turn causes the solenoid gas valve 90 to be de-energized thereby shutting off gas flow to the pan 60. The igniter 74 in turn is supplied with power so that it reaches the combustion temperature of gas before the solenoid gas valve 90 is re-opened.

Thus, the present invention provides advantages in that since the combustion gases and excess heat of combustion are withdrawn quickly from the water heater and combined with ambient air, the gases are cooled sufficiently to permit the use of inexpensive piping to vent the combustion gases atmospherically. In addition, once the burner 58 is not required to operate, gas flow to the burner 58 is completely shut off so that little or no gas is wasted. Also, once gas has been ignited, the hot surface igniter is isolated from the electrical power supply to reduce power consumption.

We claim:

1. A water heater comprising:

a tank adapted to hold water;

temperature sensing means associated with said tank for detecting the temperature of water held therein;

a burner receiving fuel to be combusted; control means responsive to said temperature sensing means and operating said burner to ignite said fuel when the temperature of water held in the tank falls below a first predetermined temperature;

vent means for discharging combustion gases, said vent means including blowing means responsive to said control means for mixing a cooling medium with said combustion gases at least while said fuel is ignited;

pressure sensing means for detecting the pressure in said vent means and being in communication with said control means, said control means further initiating said blowing means when the temperature of water held in said tank falls below said first predetermined temperature to establish at least a predetermined pressure in said vent means as detected by said pressure sensing means prior to operating said burner.

2. A water heater as defined in claim 1 wherein said control means further inhibits operation of said burner once the temperature of water held in the tank reaches a second predetermined temperature greater than or equal to said first predetermined temperature and operates said blowing means for a predetermined duration after said burner has been inhibited.

3. A water heater as defined in claim 2 wherein said cooling medium is ambient air.

4. A water heater as defined in claim 3 wherein said burner is not operated until said predetermined pressure reaches a level equal to at least 0.6 inches water column.

5. A water heater as defined in claim 4 wherein said control means includes valve means connected to a fuel supply and wherein said burner includes ignition means for igniting fuel received from said fuel supply, said control means operating said valve means and said ignition means after said blowing means establishes said predetermined pressure.

6. A water heater as defined in claim 5 wherein said pressure sensing means is connected between said ignition means and a power supply and connects said ignition means to said power supply when the pressure in said vent means reaches said predetermined pressure.

7. A water heater as defined in claim 6 wherein said valve means is in the form of a fail-safe solenoid valve responsive to said pressure sensing means and permits fuel to flow to said burner when the pressure in said vent means reaches said predetermined pressure.

8. A water heater as defined in claim 7 wherein said ignition means is in the form of an electrically operated hot surface igniter, said hot surface igniter igniting said fuel upon opening of said solenoid valve.

9. A water heater as defined in claim 8 wherein said burner further includes a temperature sensor for detecting the temperature of said burner upon ignition of said fuel and switch means for closing said solenoid valve when the ignited fuel is extinguished.

10. A water heater as defined in claim 9 wherein said temperature sensor is in the form of a mercury temperature sensor and said switch means is in the form of a mercury filled relay.

11. A water heater as defined in claim 2 wherein said blowing means is in the form of a motor driven fan.

12. A water heater as defined in claim 11 wherein said control means further includes second delay means delaying operation of said blowing means upon detection of the water temperature below said first predetermined temperature.

13. A water heater as defined in claim 12 wherein said delay means delays operation of said blowing means for approximately 20 seconds.

14. A water heater as defined in claim 10 wherein said blowing means is maintained in operation for approximately 90 seconds after said burner has been shut off by said control means.

15. A water heater as defined in claim 1 wherein said blowing means is in the form of motor driven fan.

16. A water heater as defined in claim 15 wherein said tank includes a plurality of peripherally located air inlets positioned adjacent said fan for permitting ambient air to enter said vent means.

17. A water heater as defined in claim 16 wherein said vent means includes a flue passing through said tank and an outlet pipe in communication with said flue for venting atmospherically a mixture of ambient air, combustion gases and excess heat of combustion.

18. A water heater as defined in claim 17 wherein said outlet pipe is formed from PVC or ABS.

19. A water heater as defined in claim 18 wherein said pressure sensing means is in the form of a plurality of pressure sensors located along said outlet pipe for detecting said predetermined pressure.

20. A water heater comprising:

a tank partitioned into three sections and defining a combustion chamber adjacent the bottom of said tank, a water storage chamber adapted to hold water disposed above said combustion chamber and an exhaust chamber disposed above said water storage chamber, said exhaust chamber communicating with an outlet pipe and having air inlet means therein;

a flue passing through said tank and interconnecting said combustion chamber and said exhaust chamber;

temperature sensing means located on said water storage chamber for detecting the temperature of water held therein;

a burner disposed in said exhaust chamber and receiving gas fuel to be combusted to heat water held in the tank;

valve means for controlling gas fuel flow to said burner;

control means responsive to said temperature sensing means, said control means operating said burner and opening said valve means to supply gas fuel to said burner only when the temperature of water held in said tank falls below a first predetermined temperature;

blowing means located in said exhaust chamber and being responsive to said control means, said blowing means mixing ambient air drawn into said exhaust chamber via said air inlet means with combustion gases drawn from said combustion chamber to cool said combustion gases and forcing said ambient air and combustion gas mixture into said outlet pipe to vent said mixture atmospherically, said control means initiating said blowing means when said water temperature falls below said first predetermined temperature and prior to operation of said burner; and pressure sensing means monitoring the pressure in said exhaust chamber and being in communication with said control means, said control means being responsive to said pressure sensing means and inhibiting operation of said burner when said water temperature falls below said predetermined temperature until a predetermined pressure in said exhaust chamber is established by said blowing means.

21. A water heater as defined in claim 20 wherein said control means further inhibits operation of said burner once the water temperature reaches a second predetermined temperature greater than or equal to said first predetermined temperature and operates said blowing means for a predetermined duration after said burner has been inhibited.

22. A water heater as defined in claim 21 wherein said burner is not operated until said predetermined pressure reaches a level equal to at least 0.6 inches water column.

23. A water heater as defined in claim 22 wherein said burner includes a hot surface igniter for igniting gas fuel received via said valve means, said control means opening said valve means and operating said hot surface igniter after said blowing means establishes said predetermined pressure.

24. A water heater as defined in claim 23 wherein said control means delays operation of said blowing means for approximately 20 seconds after said water temperature falls below said first predetermined temperature.

25. A water heater as defined in claim 21 wherein said blowing means is maintained in operation for approximately 90 seconds after said burner has been shut off by said control means.

26. A water heater as defined in claim 20 wherein said blowing means includes a motor-driven fan.

27. A water heater as defined in claim 26 wherein said air inlet means is in the form of a plurality of peripherally located air inlets formed in said exhaust chamber thereby permitting ambient air to enter said exhaust chamber.

28. A water heater as defined in claim 27 wherein said outlet pipe is formed from PVC or ABS.

29. A gas-fired water heater comprising:

a tank adapted to hold water;

first temperature sensing means associated with said tank for detecting the temperature of water held in said tank;

a burner receiving gas to be ignited and including a hot surface igniter for igniting said gas;

valve means controlling the flow of gas to said burner;

second temperature sensing means adjacent said igniter and detecting the temperature of said igniter and ignited gas;

control means responsive to said first temperature sensing means, said control means operating said igniter only when the temperature of water held in said tank falls below a first predetermined temperature so that said igniter reaches at least the combustion temperature of said gas, said control means being responsive to said second temperature sensing means and opening said valve means when said second temperature sensing means detects said igniter at said combustion temperature so that said igniter ignites said gas; and vent means for discharging combustion gases from said water heater.

30. A water heater as defined in claim 29 wherein said control means shuts off said igniter when said valve means is open.

31. A water heater as defined in claim 30 wherein said control means closes said valve means and operates said igniter when the temperature at said burner is detected below said combustion temperature by said second temperature sensing means and while the temperature of water in said tank is below said first predetermined temperature, said control means re-opening said valve means and shutting off said igniter when said igniter reaches at least said combustion temperature.

32. A water heater as defined in claim 31 wherein said second temperature sensing means is in the form of a mercury sensor and said control means includes a mercury filled relay responsive to said mercury sensor.

33. A water heater as defined in claim 32 wherein said valve means is in the form of a fail-safe solenoid valve.

34. A water heater as defined in claim 33 wherein said vent means includes blowing means responsive to said control means for mixing ambient air with said combustion gases, said water heater further including pressure sensing means detecting the pressure in said vent means and being in communication with said control means, said control means initiating said blowing means when the temperature of water held in said tank falls below said first predetermined temperature to establish at least a predetermined pressure in said vent means as detected by said pressure sensing means prior to operating said burner.

35. A water heater as defined in claim 34 wherein said control means further inhibits operation of said burner once the temperature of water held in the tank reaches a second predetermined temperature greater than or equal to said first predetermined temperature and operates said blowing means for a predetermined duration after said burner has been inhibited.

36. A water heater as defined in claim 35 wherein said burner is not operated until said predetermined pressure reaches a level equal to at least 0.6 inches water column.

37. A water heater as defined in claim 36 wherein said blowing means is in the form of a motor driven fan.

38. A water heater as defined in claim 37 wherein said tank includes a plurality of peripherally located air inlets positioned adjacent said fan for permitting ambient air to enter said vent means.

39. A water heater as defined in claim 38 wherein said vent means further includes a flue passing through said tank and an outlet pipe in communication with said flue for venting atmospherically a mixture of ambient air, combustion gases and excess heat of combustion.

40. A water heater as defined in claim 39 wherein said outlet pipe is formed from PVC or ABS.

* * * * *